US006348004B1

(12) United States Patent
Houben

(10) Patent No.: US 6,348,004 B1
(45) Date of Patent: Feb. 19, 2002

(54) AMUSEMENT DEVICE COMPRISING A CARRIAGE WHICH CAN BE MOVED OVER A GUIDE

(76) Inventor: Jacob Hubert Marie Houben, "Olmenhof" Sportlaan 7, B-3680 Maaseik (BE)

( * ) Notice: Subject to any disclaimer, the term of this patent is extended or adjusted under 35 U.S.C. 154(b) by 0 days.

(21) Appl. No.: 09/402,501

(22) PCT Filed: Mar. 27, 1998

(86) PCT No.: PCT/NL98/00172

§ 371 Date: Oct. 4, 1999

§ 102(e) Date: Oct. 4, 1999

(87) PCT Pub. No.: WO98/45007

PCT Pub. Date: Oct. 15, 1998

(30) Foreign Application Priority Data

Apr. 4, 1997 (NL) ..... 1005727

(51) Int. Cl.[7] ..... A63G 1/34
(52) U.S. Cl. ..... 472/43; 472/45
(58) Field of Search ..... 472/29, 36, 39, 472/45, 46, 43; 104/53, 55, 58, 66, 89, 91, 92

(56) References Cited

U.S. PATENT DOCUMENTS 5,272,984 A * 12/1993 Bollinger et al. ..... 104/63
5,964,665 A * 10/1999 Uemura ..... 475/45

FOREIGN PATENT DOCUMENTS

| | | |
|---|---|---|
| DE | 104 899 C | 8/1898 |
| DE | 109 639 C | 8/1898 |
| GB | 2 109 252 A | 6/1983 |
| WO | WO 84/00899 | 3/1984 |

* cited by examiner

*Primary Examiner*—Kien T. Nguyen
(74) *Attorney, Agent, or Firm*—Skjerven Morrill MacPherson LLP; Alan H. MacPherson

(57) ABSTRACT

A method for moving at least one carriage over a guide by transport mechanism, wherein the carriage, which can be moved over the guide, is connected to an engaging mechanism, which can be moved by the transport mechanism, whereupon the carriage is moved in a direction of transport over the guide by the engaging mechanism, after which the engaging mechanism is moved with respect to the carriage in a direction opposed to the direction of transport, and the engaging mechanism is disconnected from the carriage. An amusement device utilizing the above method is also disclosed.

17 Claims, 11 Drawing Sheets

28
69
68
55
67
P7
P8
P6
P5
65
59
66
63
64
62
58
61
56
60
35
36
57

AMUSEMENT DEVICE COMPRISING A CARRIAGE WHICH CAN BE MOVED OVER A GUIDE

The invention relates to a method for moving at least one carriage over a guide by transport means according to the preamble of claim 1.

The invention also relates to an amusement device comprising at least one carriage which can be moved over a guide according to the preamble of claim 6.

With a method of this kind, which is known per se and which is for example used in an amusement device such as a so-called roller coaster, a boomerang and the like, a carriage is transported over a guide over a predetermined distance, after which the carriage is disconnected from the transport means, and the carriage is moved over the guide in the direction in which the carriage has been transported by the transport means, or in a direction opposite thereto, as a result of the speed it has built up or as a result of the force of gravity. The connection between the transport means and the carriage must be relatively strong, in order to prevent the carriage from being disconnected undesirably. In particular if the guide is disposed at an upward angle, the forces which the carriage exerts on the engaging mechanism will be relatively large. With the known device the disconnecting of the transport means requires relatively much energy, therefore.

The object of the present invention is to provide a method wherein the connecting and disconnecting of the transport means to and from the carriage can take place in a relatively simple manner.

This objective is accomplished with the method according to the invention by moving said engaging mechanism relative with respect to said carriage in a direction opposed to the direction of transport.

By moving the engaging mechanism in a direction opposed to the direction of transport, the forces which the carriage exerts on the engaging mechanism are reduced, so that the engaging mechanism can be disconnected from the carriage with relatively little force.

It has to be noted that from DE-C-104.899 an amusement device is known comprising a carriage which is provided with an engaging mechanism. The engaging mechanism can be connected and disconnected to a transport cable.

Also GB-A-2.109.252 and WO-A-84/00899 disclose such type of amusement devices comprising a carriage which can be displaced over a guide by means of a transport means.

One embodiment of the method according to the invention is characterized in that the engaging mechanism, which is connected to the carriage, is decelerated near a predetermined place, whereby the carriage is moved further in the direction of transport as a result of its own mass inertia, after which the engaging mechanism is disconnected from the carriage.

When the engaging mechanism is being decelerated, the carriage, which will weigh 5–15 tonnes when used in an amusement device, will continue to move at the original speed of the engaging mechanism for a moment, due to the mass inertia. The forces being exerted on the engaging mechanism by the carriage will be reduced thereby, which makes it possible to open the engaging mechanism with relatively little force and to disconnect the carriage.

Another embodiment of the method according to the invention is characterized in that the carriage is connected to a clamping mechanism near an upper end of the guide which is disposed at an angle, after which the engaging mechanism is moved in a direction away from the clamping mechanism and the engaging mechanism is disconnected from the carriage, after which the carriage is disconnected from the clamping mechanism.

By moving the engaging mechanism in a direction away from the clamping mechanism, the forces exerted on the engaging mechanism by the carriage will be reduced, so that the engaging mechanism can be disconnected from the carriage.

Another embodiment of the method according to the invention is characterized in that before the engaging mechanism is connected to the carriage being moved over said guide, said engaging mechanism is moved to an engaging position within an engaging area, which position substantially corresponds with the expected position of the carriage.

A method of this kind is in particular suitable for engaging a carriage moving over the guide at a decreasing speed, whereby the carriage can be transported further in the direction of transport after being connected to the engaging mechanism. In order to have the connection between the engaging mechanism and the carriage together take place in an optimum manner, the expected position of the carriage in an engaging area further down the guide is determined, for example on the basis of the speed of the carriage at a predetermined location. Then the engaging mechanism is moved to said engaging position, and the carriage is connected to the engaging mechanism at this engaging position and subsequently transported further.

Yet another embodiment of the method according to the invention is characterized in that before the engaging mechanism is connected to the carriage being moved over said guide, said engaging mechanism is imparted an engaging speed in the direction of transport within an engaging area, which speed is practically equal to the expected speed of the carriage.

As a result of this, the occurrence of bumps when the engaging mechanism is being connected to the carriage is prevented, since the speed of the engaging mechanism and that of the carriage will be practically equal at the moment of connecting.

The invention will be explained in more detail with reference to the drawings, in which.

Parts that correspond with each other are indicated by the same numerals in the figures.

Figure 1A:
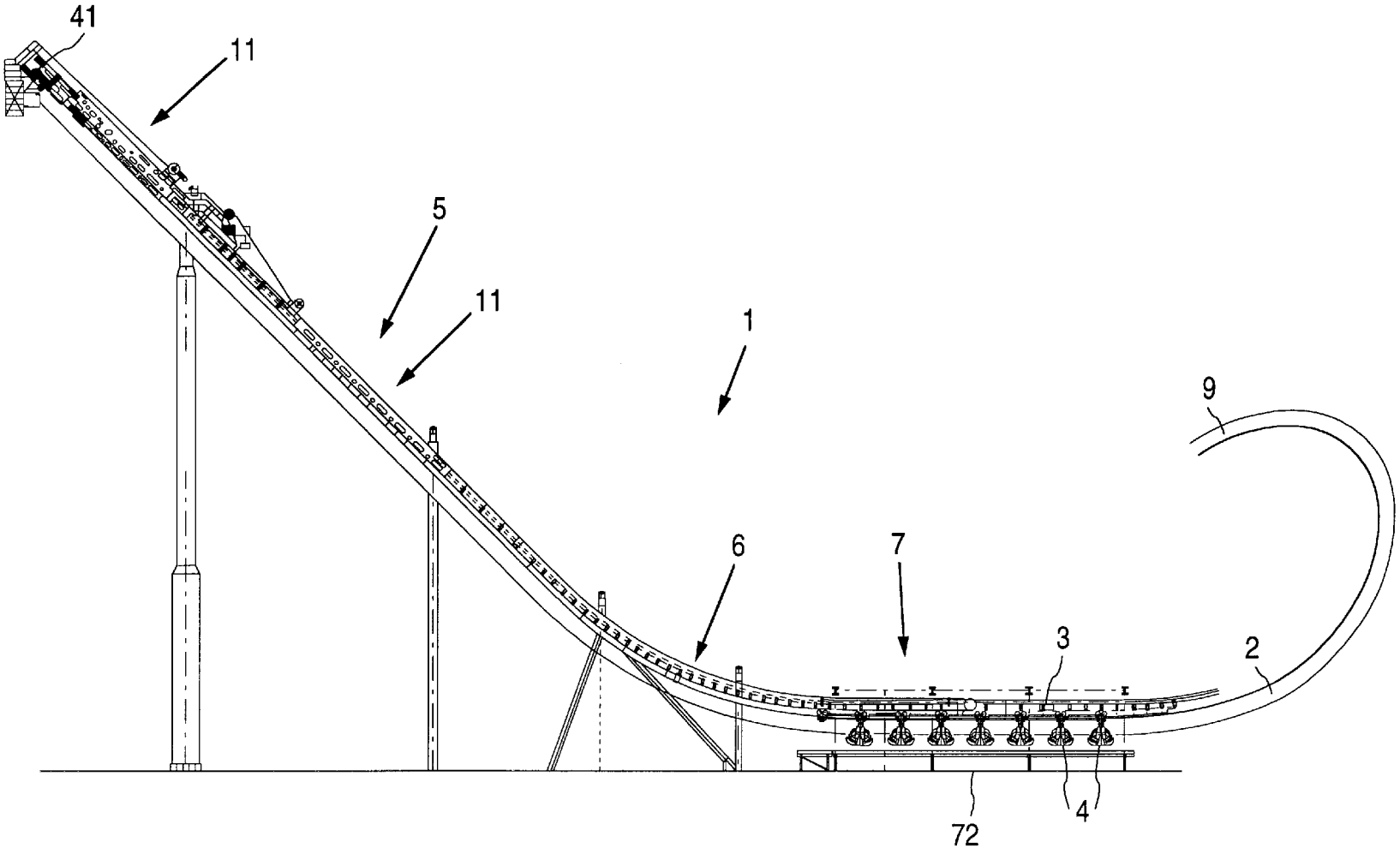
FIGS. 1A and 1B show parts of an amusement device according to the invention.
Figure 1B:
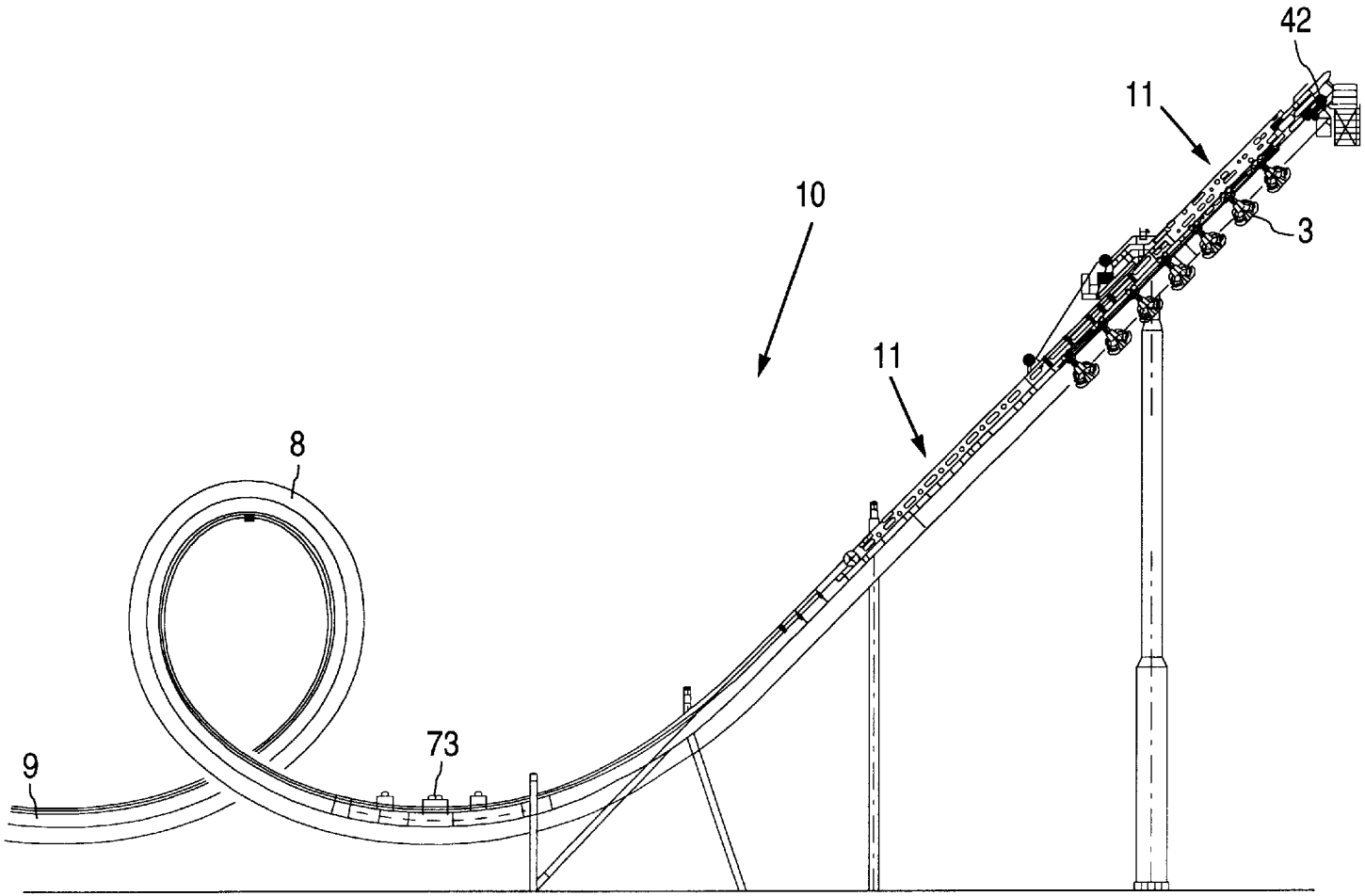

FIGS. 1A and 1B show parts of an amusement device 1, which comprises an elongated guide 2, over which a train 3 consisting of a number of carriages 4 can be moved. Guide 2 comprises a first portion 5, which extends upwards at an angle, a straight portion 7, which is connected thereto via a bend 6, a curved portion 9 provided with a looping 8, which is connected to said straight portion, and portion 10 contiguous to looping 8, which extends upwards at an angle.

Figure 2:
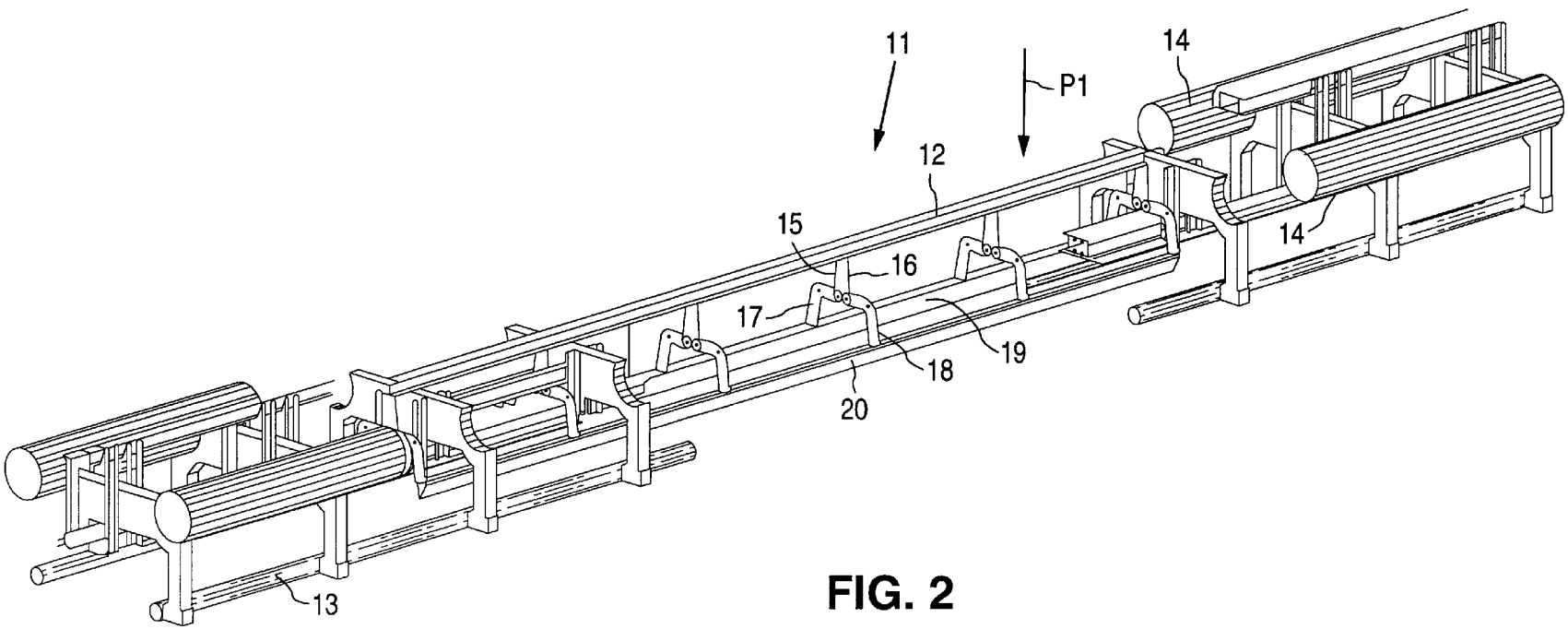
FIG. 2 is a perspective view of means for opening an engaging mechanism of the device shown in FIGS. 1A and 1B.

FIG. 2 is a perspective view of a mechanism 11, by means of which an engaging mechanism yet to be described in more detail can be opened. Mechanism 11 comprises an elongated beam 12, which extends parallel to the tubes 13, 14 forming guide 2. A number of pairs of arms 15, 16 are pivotally connected to beam 12, which arms are pivotally connected to L-shaped arms 17, 18 on a side remote from beam 12. The spaced-apart arms 17 are interconnected by an elongated strip 19, whilst the spaced-apart arms 18 are interconnected by an elongated strip 20. Strips 19, 20 form arms, which can be connected to the engaging mechanism in a manner yet to be indicated in more detail. Beam 12 can be moved in a direction indicated by arrow P1, and in a direction opposite thereto, by means of a number of pistons (not shown) being movable in cylinders.

Figure 3B:
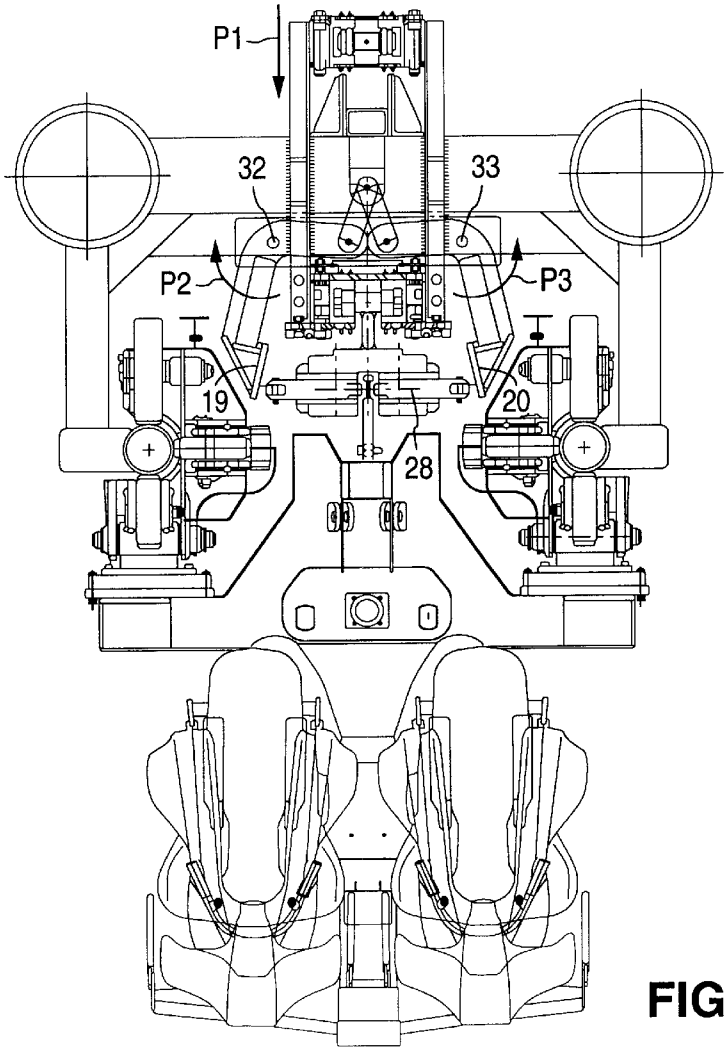
FIGS. 3A and 3B are cross-sectional views of the amusement device shown in FIGS. 1A and 1B, showing an engaging mechanism in open and in closed condition respectively.
Figure 3A:
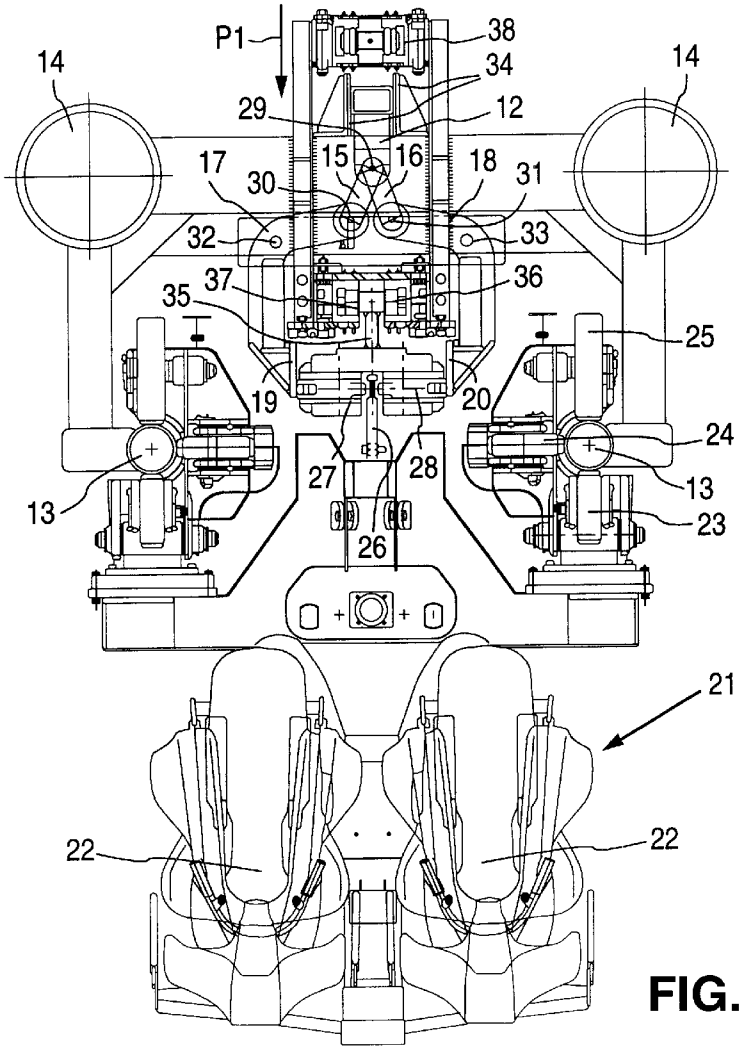

FIGS. 3A and 3B are cross-sectional views of the amusement device 1 shown in FIGS. 1A and 1B, showing a carriage 21 which can be moved over guide tubes 13. Carriage 21 comprises two seats 22 arranged in side-by-side relationship, and two seats 22 disposed behind said seats, on which persons can be seated. Carriage 21 is translatably supported on guide tubes 13 by means of two sets of three wheels 23, 24, 25. Carriage 21 furthermore comprises a flange 26 extending parallel to guide tubes 13, which extends into a slot 27 of an engaging mechanism 28. Carriage 21 can be supported with respect to guide tubes 13 in any selected manner, and also the position, the attachment and construction of seats 22 can be freely selected. Arms 15, 16 of mechanism 11 pivot about a pivot pin 29 with one end, and they are pivotally connected to L-shaped arms 17, 18 with an end remote from pivot pin 29 via pivot pins 30 and 31 respectively. Arms 17, 18 are furthermore capable of pivoting movement about pivot pins 32, 33, which are fixedly disposed with respect to rods 14. Beam 12 is capable of translating movement on guide 34 in a direction indicated by arrow P1.

Beam 12 can be moved from the position illustrated in FIG. 3A, in a direction indicated by arrow P1, to the position illustrated in FIG. 3B by means of a number of pistons being movable in cylinders, whereby arms 16, 18 are pivoted about pivot pins 32, 33 in directions indicated by arrows P2 and P3 respectively, as a result of which strips 19, 20 will be positioned clear of engaging mechanism 28.

Engaging mechanism 28 is connected, via a flange 35, to a connecting piece 36, which forms part of an endless chain or steel cable, which is capable of translating movement in guides 37, 38.

Figure 4A:
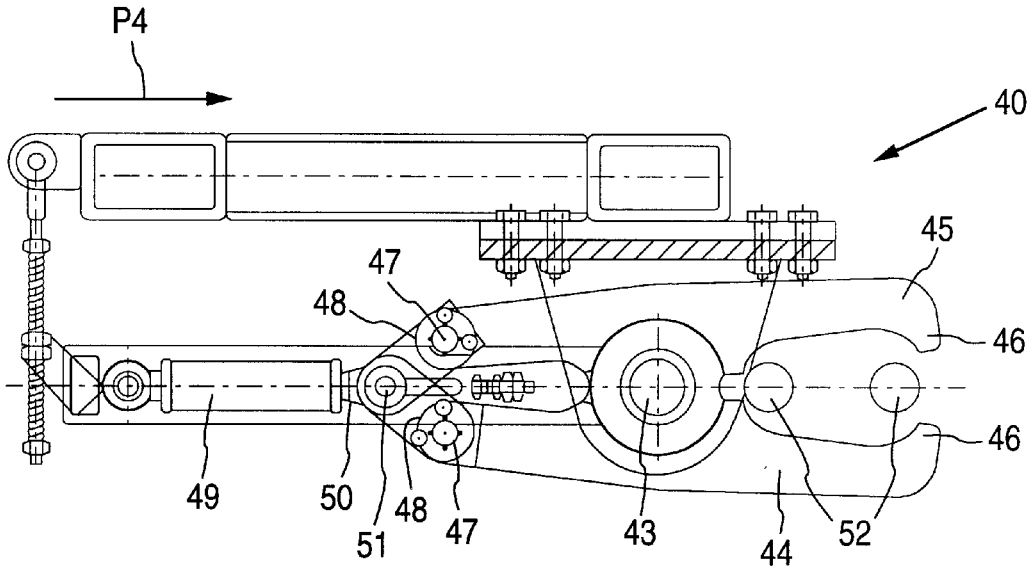
FIGS. 4A and 4B show a clamping mechanism of the amusement device of FIGS. 1A and 1B in open and in closed condition respectively.
Figure 4B:
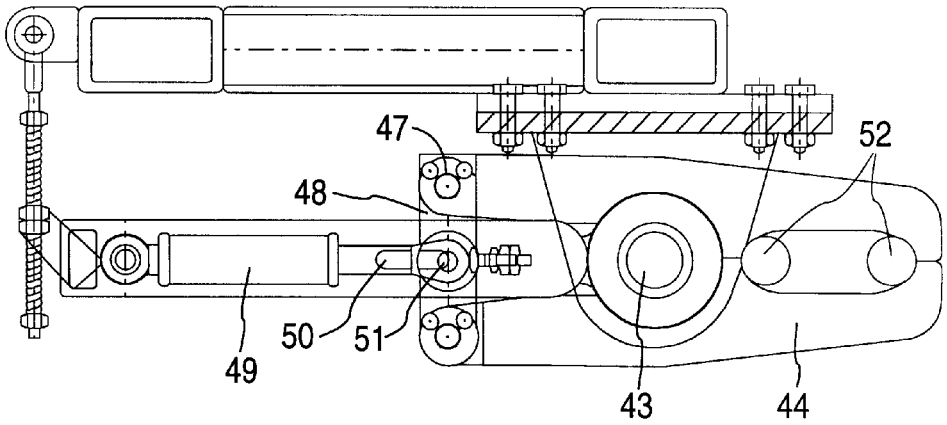

FIGS. 4A and 4B show a clamping mechanism 40 according to the invention, which is disposed near ends 41, 42 of the amusement device 1 shown in FIGS. 1A and 1B. Clamping mechanism 40 comprises two levers 44, 45, which pivot about a pivot pin 43, and which are provided with claws 46 at one end, and which are pivotally connected to connecting piece 48, via pivot pins 47, on a side remote from claws 46. Connecting pieces 48 are pivotally connected together and to one end of a piston 50 being movable in a cylinder 49, on a side remote from pivot pins 47, via a pivot pin 51. Piston 50 is capable of movement in cylinder 49 in a direction indicated by arrow P4, whereby connecting pieces 48 and levers 44, 45 are pivoted about the respective pivot pins, from the position shown in FIG. 4A to the position shown in FIG. 4B. Claws 46 thereby move from the open position which is shown in FIG. 4A to the closed position which is shown in FIG. 4B. Pins 52 are shown to be present in claws 46, which pins form part of the train 3 comprising carriages 4.

In the closed position of the claws 46 which is shown in FIG. 4B, connecting pieces 48 are in line, as a result of which the force which is required for keeping the claws 46 in their closed position by means of cylinder 49 is relatively small.

Figures 5A, 5B:
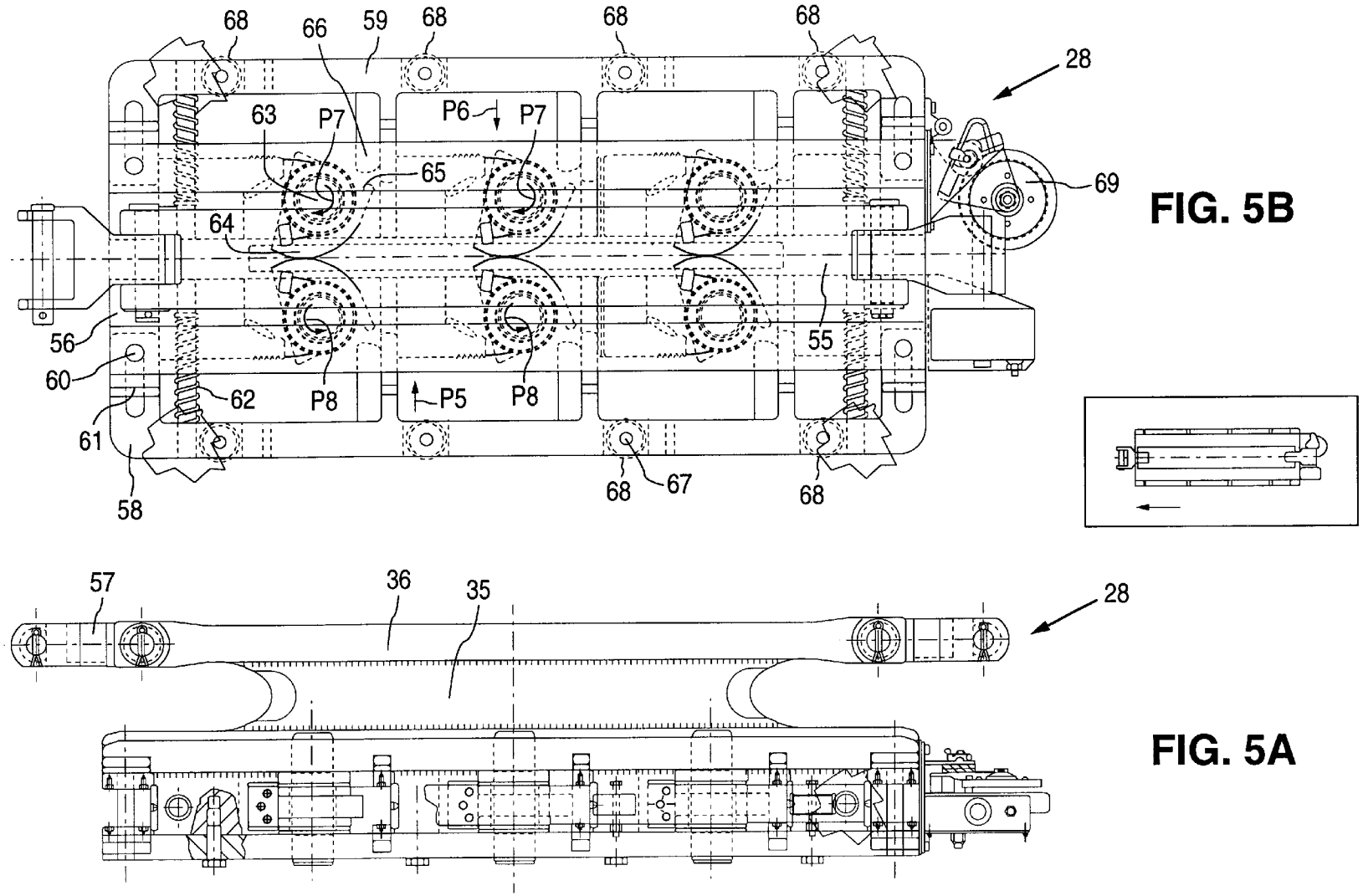
FIGS. 5A and 5B are a cross view and a bottom view respectively of an engaging mechanism of the amusement device of FIGS. 1A and 1B.

FIGS. 5A and 5B are a cross view and a bottom view respectively of an engaging mechanism 28, which comprises a carrier 56 provided with a slot 55, which carrier is rigidly connected, via a flange 35, to a connecting piece 36, which forms part of a transport chain 57. Engaging mechanism 28 furthermore comprises two slides 58, 59, which can move with respect to carrier 56 in directions transversely to slot 55, as indicated by arrows P5, P6. Said slides are each connected to carrier 56 via two mortise joints 60, 61. Springs 62 are furthermore disposed between carrier 56 and slides 58, 59, which springs urge the slides in directions opposed to the directions indicated by arrows P5, P6. Carrier 56 comprises six claw-shaped cams 63, which are arranged in pairs, in mirror symmetry with respect to slot 55. Each cam 63 comprises a toothed clamping portion 64, which extends into slot 55, and an activating portion 65, which is disposed opposite a flange 66 secured to a nearby slide 58, 59. The cams 63 positioned near slide 59 can pivot against spring force in a direction indicated by arrow P7, whilst the cams positioned near slide 58 can pivot against spring force in a direction indicated by arrow P8. Slides 58, 59 are furthermore provided with rollers 68 which are rotatable about axes of rotation 67, which rollers 68 extend beyond the sides of slides 58, 59 that face away from slot 45.

Engaging mechanism 28 furthermore comprises a mechanism 69, by means of which the speed of the engaging mechanism relative to a flange 26 which is connected to the carriage, and which is to be engaged by said engaging mechanism, can be measured.

Figure 6C:
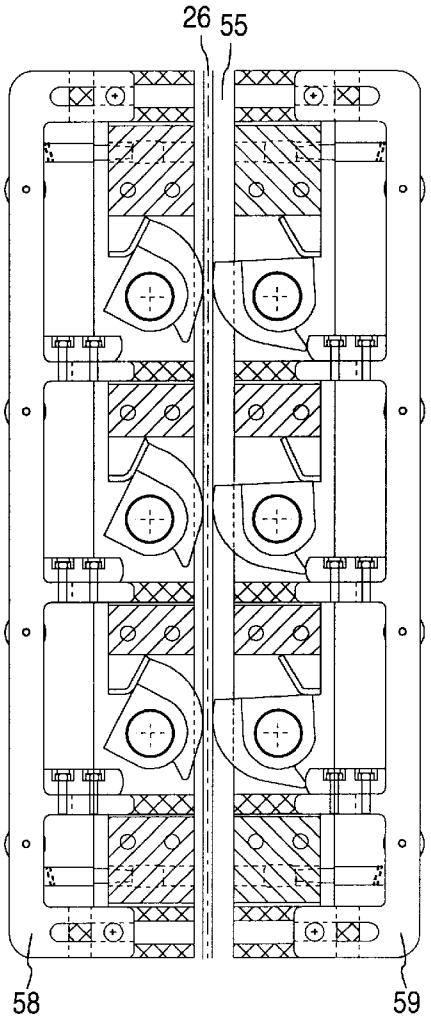
FIGS. 6A–6C show various positions of the engaging mechanism shown in FIGS. 5A–5B.
Figure 6B:
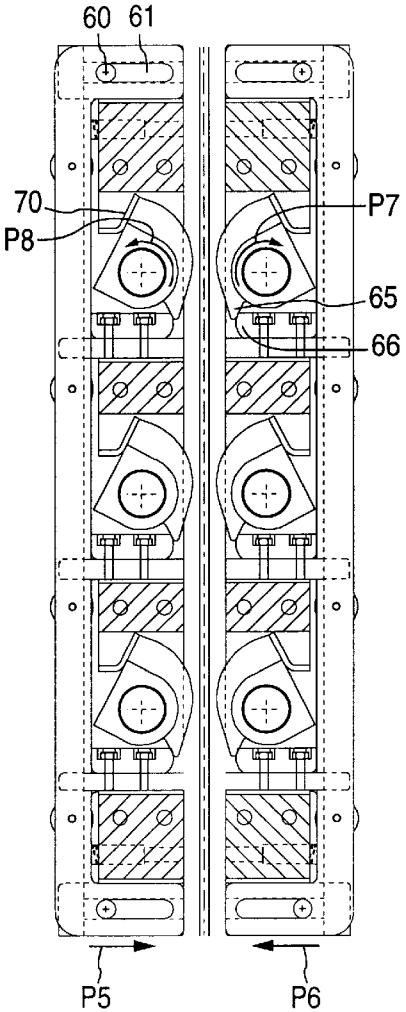
Figure 6A:
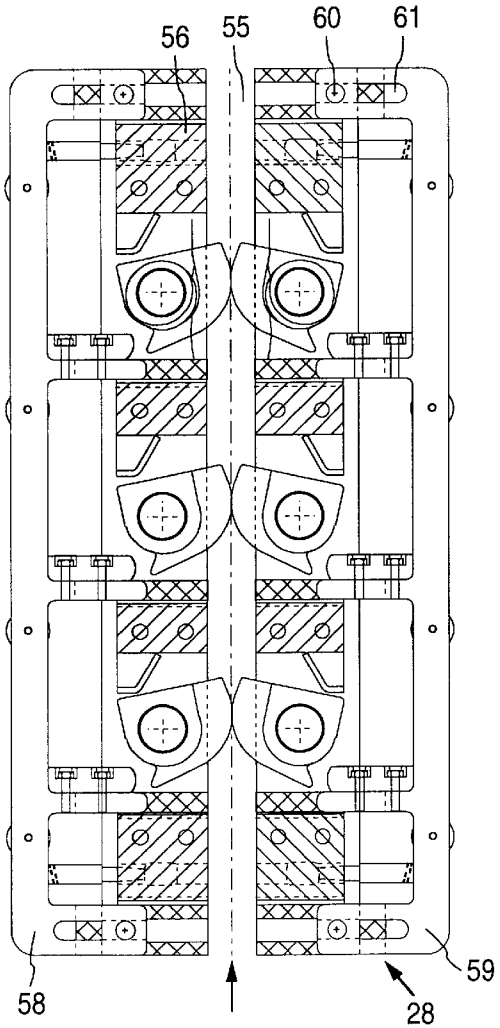

FIGS. 6A–6C show various positions of the engaging mechanism which is shown in FIGS. 5A and 5B. FIG. 6A shows the engaging mechanism 28 to be in a clamping position, wherein the opposite cams 63 abut against each other. Flanges 66 come into contact with the activating portions 65 on cams 63 by moving the slides 58, 59 from the clamping position illustrated in FIG. 6A in the directions indicated by arrows P5, P6, as a result of which cams 63 will be pivoted in the directions indicated by arrows P7, P8, until said cams abut against stop surfaces 70 present on the carrier.

FIG. 6C shows a clamping position of engaging mechanism 28, wherein a flange 26 connected to a carriage is positioned in slot 55, whereby flange 26 is disposed closer to slide 58 than to slide 59. Consequently, the cams positioned near slide 58 have been pivoted in the direction indicated by arrow P8 over a distance which is larger than the distance over which the cams positioned near slide 59 have been pivoted in the direction indicated by arrow P7.

The operation of the amusement device shown in FIGS. 1A and 1B will now be discussed in more detail with reference to FIGS. 7A–10C. Passengers present in a boarding station 72 located near straight portion 7 sit down in the seats 22 of the carriages 4 connected together to form a train 3. Then engaging mechanism 28 is connected to a flange 26 secured to carriage 4, after which engaging mechanism 28 is moved upwards over the curved portion 6 and the upwardly sloping portion 5 by means of endless chain 57, taking along carriages 4. The engaging mechanism is disconnected near end 41, in a manner indicated in more detail in FIGS. 8A–8C or in FIGS. 9A–9C, after which the force of gravity will cause train 3 to move downwards over portion 5, curved portion 6, straight portion 7, and portions 8, 9 to the upwardly sloping portion 10. On said upwardly sloping portion 10 the train is engaged by means of a second engaging mechanism 28, and transported to end 42 by means of a second chain 57. The train is disconnected from the engaging mechanism 28 near end 42, after which the movement of train 3 will be reversed under the influence of gravity, and the train will move towards end 41 again via portions 8, 7, 6 and 5. Train 3 is engaged by first engaging mechanism 28 again on portion 5, after which train 3 is gradually transported to station 72, where the passengers can get off and next passengers can get on the train.

Figure 7B:
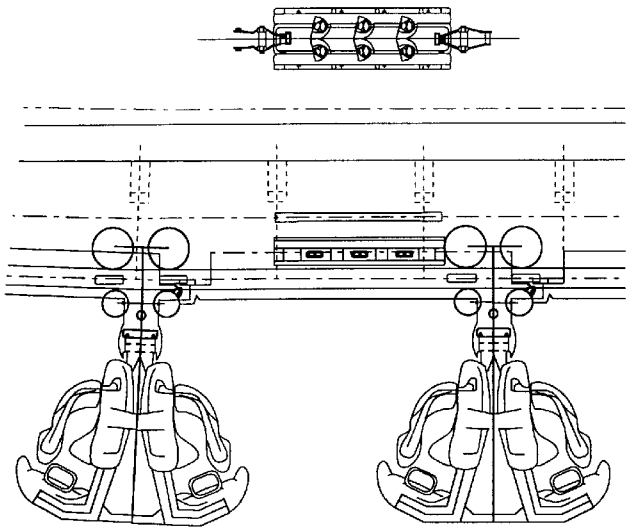
FIGS. 7A and 7B show views of carriage positioned near a number of boarding stations.
Figure 7A:
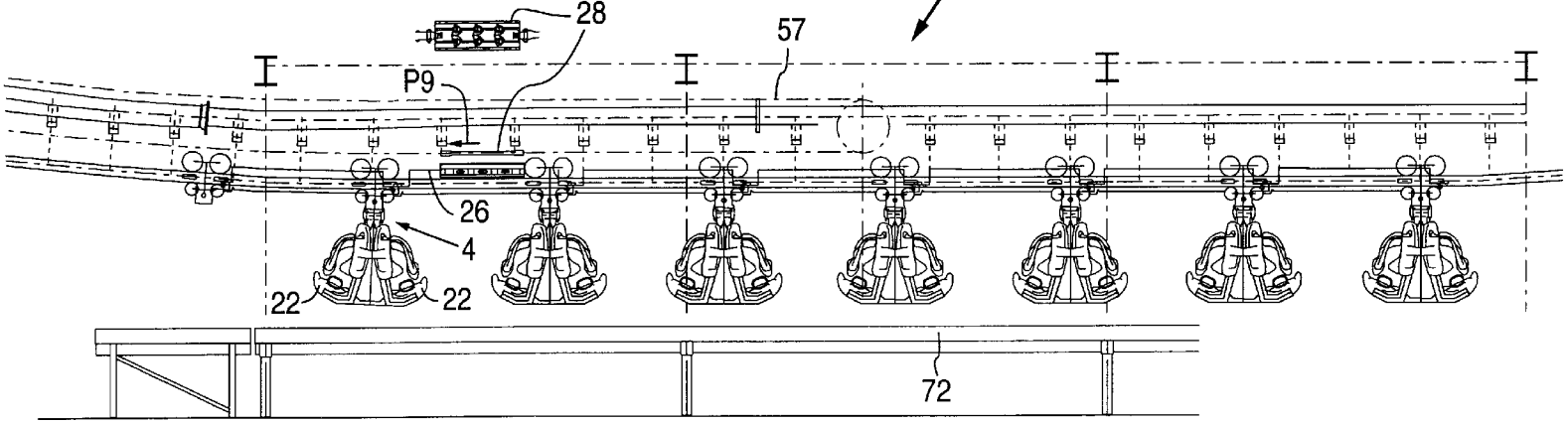

In the position shown in FIGS. 7A and 7B, the train 3 is present near boarding station 72, and the engaging mechanism 28 connected to chain 57 is in engagement with a flange 26 of a carriage. Flange 26 may occupy the position shown in FIG. 6C with respect to the engaging mechanism. Flange 26 may also occupy a position more to the centre of slot 55, however. Engaging mechanism 28 is moved from the position shown in FIG. 7A, in the direction indicated by arrow P9, by chain 57, whereby engaging mechanism 28 exerts a pulling force on flange 26, and thus on train 3, as a result of which train 3 will likewise be moved in the direction indicated by arrow P9. The train, which may weigh 5–15 tonnes when used in an amusement device of this kind, exerts a relatively large force, via flange 26, on the cams 63 being in engagement with flange 26, as a result of which cams 63 will be pulled in directions opposed to the directions indicated by arrows P7, P8. As a result of this, the curved surfaces of claw-shaped cams 63 will exert an increasing force on flange, 26.

The train 3 must be disconnected from engaging mechanism 28 the moment the train 3 nears the end 41 of sloping portion 5. FIGS. 8A–8C and 9A–9C show two different manners in which said disconnecting can be carried out.

Figure 8B:
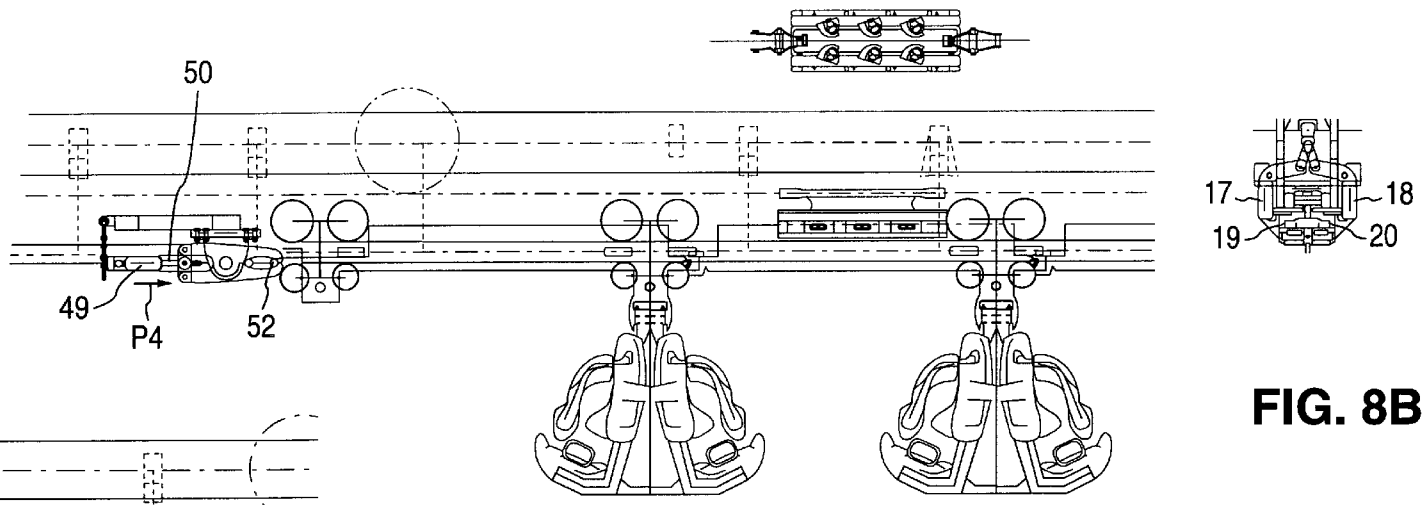
FIGS. 8A–8C are views of a number of carriages positioned near an end of the amusement device of FIGS. 1A and 1B, which is provided with a clamping mechanism as shown in FIGS. 4A and 4B.
Figure 8C:
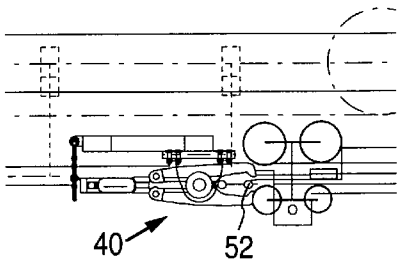
Figure 8A:
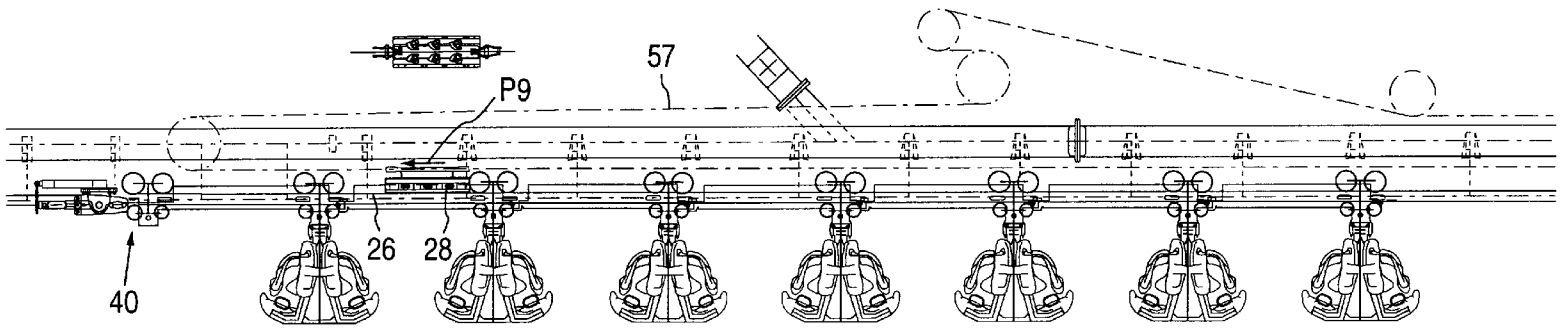

In the situation which is shown in FIGS. 8A–8C, train 3 is moved to a position near end 41, until pins 52 connected to the train are positioned within the claws 46 of clamping mechanism 40 (FIG. 8C). Once the pins 52 are positioned within claws 46, piston 50 will be moved in the direction indicated by arrow P4, until the claws 46 engage round pins 52 (see FIG. 4B). A mechanism 11, which is shown in FIG. 2, is disposed near end 41, whereby engaging mechanism 28 will be positioned in mechanism 11 when pins 52 are positioned within clamping mechanism 40. Mechanism 11 is in the open position which is shown in FIG. 3B thereby. Then beam 12 is moved in a direction opposed to the direction indicated by arrow P1, as a result of which arms 17, 18 will be pivoted in a direction opposed to the direction indicated by arrows P2, P3, and strips 19, 20 will exert forces on slide 58, 59 in the directions indicated by arrows P5, P6. The weight of the train and the resulting forces on engaging mechanism 28 via flange 26 will prevent mechanism 11 from opening engaging mechanism 28, however. Engaging mechanism 28 is then moved in a direction opposed to the direction indicated by arrow P9 by means of chain 57, whereby the train remains connected to clamping mechanism 40. This movement results in a decrease of the forces being exerted on engaging mechanism 28 by the train, as a result of which the forces being exerted on slides 58, 59 by mechanism 11 cause the cams to pivot in directions indicated by arrows P7, P8, so that the cams 63 will be positioned clear of flange 26 (see FIG. 8B). Then the piston 50 is moved in a direction opposed to the direction indicated by arrow P4, as a result of which claws 46 will be moved in a direction away from pins 52, and train 3 will start to move in a direction opposed to the direction indicated by arrow P9.

Figure 9C:
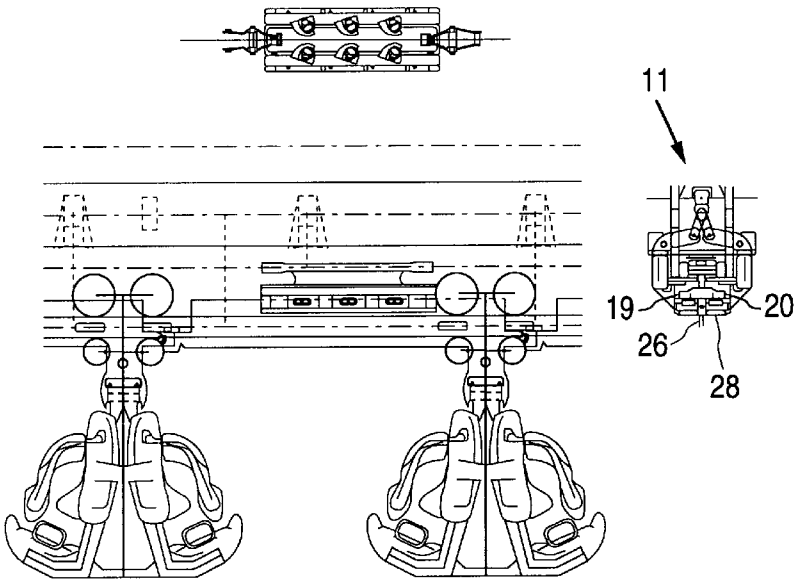
FIGS. 9A–9C are views which illustrate the manner in which a second embodiment of the amusement device shown in FIGS. 1A and 1B is disconnected from an engaging mechanism.
Figure 9B:
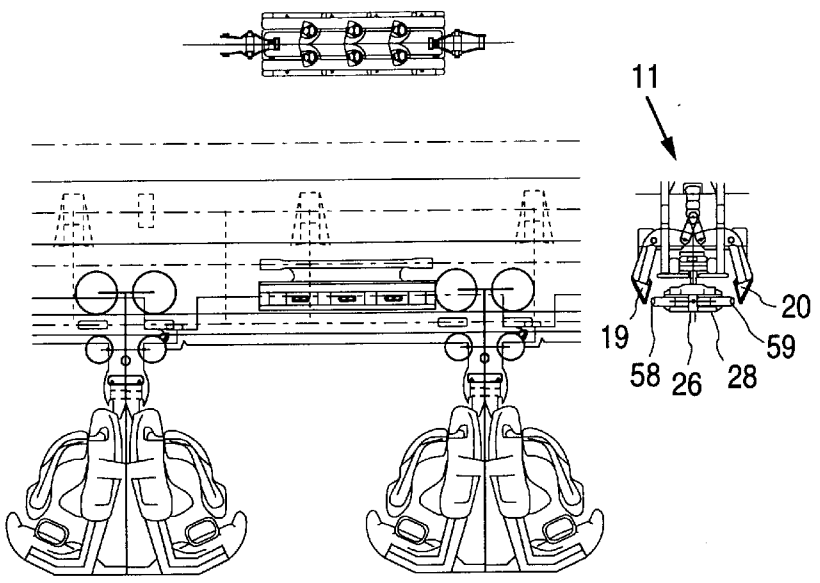
Figure 9A:
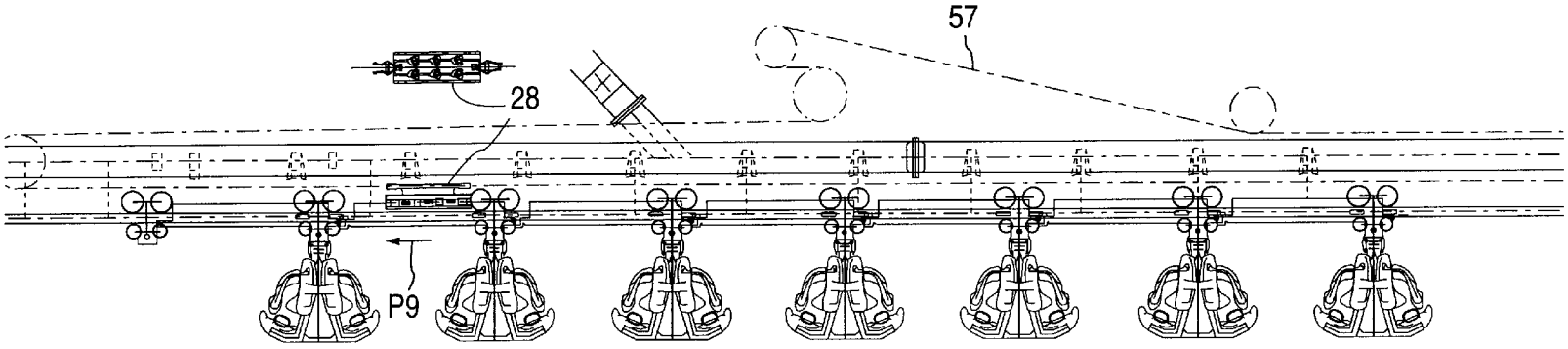

Instead of using the clamping mechanism 40, it is also possible to release the engagement between engaging mechanism 28 and flange 26 in a manner which is shown in FIGS. 9A–9C.

Engaging mechanism 28 and the train 3 connected thereto are moved over portion 5 in a direction indicated by arrow P9 until the train has almost reached end 41. Portion 5 of the amusement device 1 is provided near said end with a mechanism 11 as shown in FIG. 2, and once engaging mechanism 28 is positioned between strips 19, 20, said mechanism 11 will be moved from the position shown in FIG. 9B to a position in which strips 19, 20 exert forces on slides 58, 59 in directions indicated by arrows P5, P6. A relative movement in the direction indicated by arrow P9 takes place thereby between engaging mechanism 28 and strips 19, 20, whereby rollers 68 on slides 58, 59 roll over strips 19, 20. Slides 58, 59 cannot cause cams 63 to pivot in the directions indicated by arrows P7, P8 yet, due to the forces which train 3 exerts on engaging mechanism 28 via flange 27. Then the speed at which engaging mechanism 28 is moved in the direction indicated by arrow P9 by means of chain 57 is decreased. Due to the mass inertia, the train will maintain its prior speed in the direction indicated by arrow P9 for a short time, as a result of which the train will move in the direction indicated by arrow P9 with respect to the engaging mechanism. A force which will facilitate the pivoting of cam 63 in the directions indicated by arrows P7, P8 will be exerted on flange 26 thereby. At the same time mechanism 11 will exert forces on slides 58, 59 in the directions indicated by arrows P5, P6, as a result of which said cam will pivot in the directions indicated by arrows P7, P8 and said cam will be positioned clear of flange 26. Train 3 will come to a standstill near end 41 under the influence of the force of gravity, and subsequently it will start to move in a direction opposed to the direction indicated by arrow P9. FIG. 9C shows the position of clamping mechanism 11 after engaging mechanism 28 has been disconnected from flange 26.

Figure 10C:
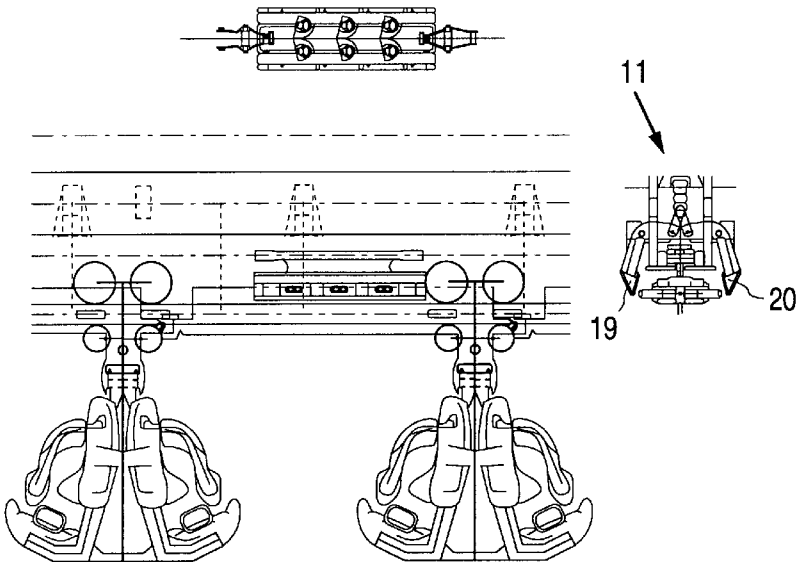
FIGS. 10A–10C are views which illustrate the manner in which a number of carriages of the amusement device shown in FIGS. 1A–1B are engaged by means of the engaging mechanism.
Figure 10B:
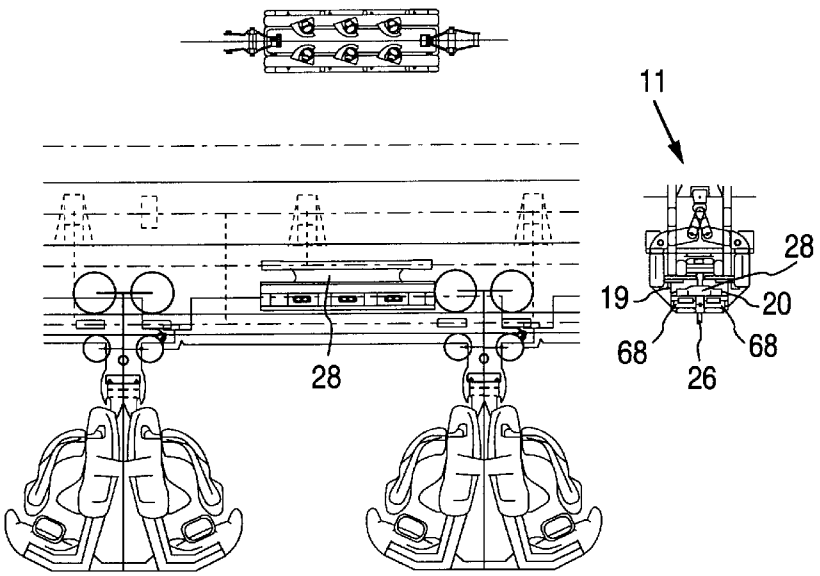
Figure 10A:
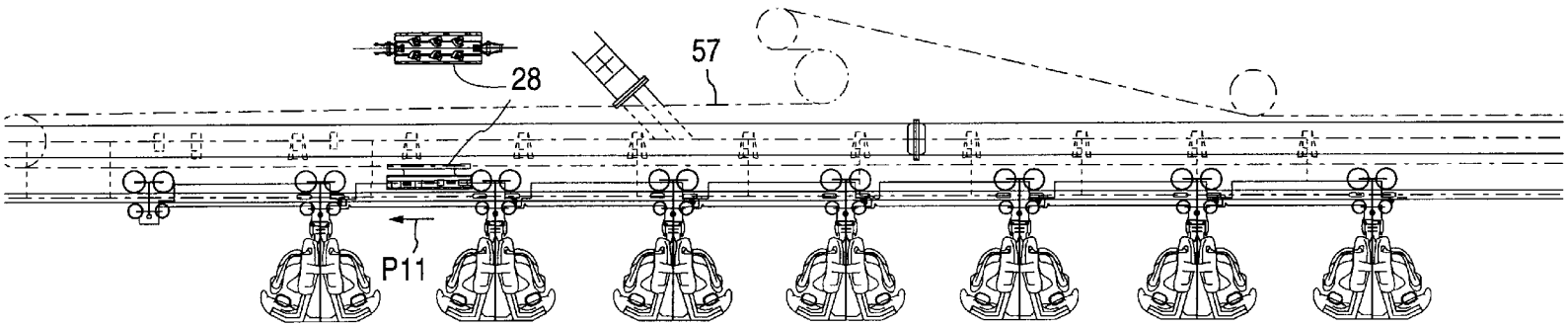

After the train 3 has come to a standstill near end 41 and has started to move in a direction opposed to the direction indicated by arrow P9, train 3 will pass through station 72, after which train 3 will pass portion 9 comprising looping 8 and move to portion 10. The train 3 must be moved to a position near the end 42 in order to give it sufficient potential energy to move from portion 10 to portion 5 again. To this end train 3 must be coupled to a second engaging mechanism 28, which is connected to a second chain 57 (see FIGS. 10A–10C). In order to prevent the occurrence of bumps caused by differences in speed between the engaging mechanism and the train, engaging mechanism 28 is imparted the same speed as train 3 before the connection between the engaging mechanism and train 3 is made. To this end the speed of train 3 is measured at a position located some distance away from chain 57, for example position 73 (see FIG. 1B). The expected speed of train 3 is calculated on the basis of the speed of train 3 near point 73, which takes place at the moment when flange 26 is positioned approximately centrally in a first mechanism 11, which is disposed in a central part of portion 10 of amusement device 1. Then the engaging mechanism 28 is moved to this position by means of chain 57, whereby care is taken that engaging mechanism 28 is positioned near the centre of mechanism 11 at the same moment that flange 26 is positioned near the centre of mechanism 11, and that engaging mechanism 28 at the same time has a speed which corresponds with the expected speed of the train near the centre of mechanism 11. Mechanism 11 keeps engaging mechanism 28 in the open position which is shown in FIG. 3A thereby. Engaging mechanism 28 is moved with respect to mechanism 11 by means of chain 57, whereby the rollers 68 present on slides 58, 59 roll on strips 19, 20 (FIG. 10B). Once flange 26 is positioned within slot 55 of engaging mechanism 28, mechanism 11 will be pivoted from the position which is shown in FIG. 3A to the position which is shown in FIG. 3B, as a result of which slides 58, 59 will be moved in a direction opposed to the direction indicated by arrows P5, P6 by the spring force exerted by springs 62, and cams 63 will be brought into engagement with flange 26. Since engaging mechanism 28 and flange 26 move at practically the same speed, the persons present in the train will not experience a bump thereby. Engaging mechanism 28 is now connected to flange 26, and because engaging mechanism 28 is moved in a direction indicated by arrow P11 by means of chain 57, also the train 3 will be transported in a direction indicated by arrow P11, towards end 42. Once the train 3 is present near end 42, engaging mechanism 28 will be disconnected from the train 3 in the manner described with reference to FIGS. 8A–8C or FIGS. 9A–9C, after which train 3 will be moved in a direction opposed to the direction indicated by arrow P11 under the influence of the force of gravity. Train 3 will then return to portion 5, in the central part of which a mechanism 11 will be positioned. In the meantime engaging mechanism has been moved into said lower mechanism 11, whereby a connection can be effected between engaging mechanism 28 and train 3, in the manner described with reference to FIGS. 10A–10C. Once engaging mechanism 28 has been connected to train 3, train 3 will be transported to station 72, after which the cycle can be repeated again.

Engaging mechanism 28 may also be transported by means of a linear motor, whereby a side of the engaging mechanism 28 remote from train 3 is provided with a part of said linear motor.

Engaging mechanism 28 may be carried through the curved portion 6 of amusement device 1 in that engaging mechanism 28 forms part of a flexible chain which is movable transversely to the guide.

It is also possible to use the engaging mechanism only for engaging the train whilst the train is being moved.

It is also possible to place the train on the guides instead of under the guides. Furthermore it is possible to construct the seat in such a manner that a person accommodated therein must assume a standing, a reclined or a seated position.

It is also possible to accelerate the train by means of the engaging mechanism, whereby the train will be disconnected from the engaging mechanism in the above-described manner as soon as the desired acceleration has been effected. The train is thereby catapulted, as it were.

What is claimed is:

1. A method for moving at least one carriage over a guide by transport means, wherein the carriage is connectable to an engaging mechanism movable by the transport means, comprising:

moving the carriage in a direction of transport over the guide by means of the engaging mechanism; and disconnecting the engaging mechanism from the carriage by moving the engaging mechanism relative to the carriage in a direction opposed to the direction of transport.

2. A method according to claim 1, characterized in that the engaging mechanism, which is connected to the carriage, is decelerated near a predetermined place, whereby the carriage is moved further in the direction of transport as a result of its own mass inertia, after which the engaging mechanism is disconnected from the carriage.

3. A method according to claim 1, characterized in that the carriage is connected to a clamping mechanism near an upper end of the guide which is disposed at an angle, after which the engaging mechanism is moved in a direction away from the clamping mechanism and the engaging mechanism is disconnected from the carriage, after which the carriage is disconnected from the clamping mechanism.

4. A method according to claim 1, characterized in that before the engaging mechanism is connected to the carriage being moved over said guide, said engaging mechanism is moved to an engaging position within an engaging area, which position substantially corresponds with the expected position of the carriage.

5. A method according to claim 1, characterized in that before the engaging mechanism is connected to the carriage being moved over said guide, said engaging mechanism is imparted an engaging speed in the direction of transport within an engaging area, which speed is practically equal to the expected speed of the carriage.

6. An amusement device comprising:

a guide;

at least one carriage movable over said guide;

an engaging mechanism connectable to said carriage, and movable by transport means in a direction of transport extending parallel to said guide, said engaging mechanism exerting spring force against said carriage during transport; and means for disconnecting said engaging mechanism from said carriage against said spring force when said engaging mechanism is being moved relative to said carriage.

7. An amusement device according to claim 6, wherein said engaging mechanism is movable in the direction of transport with respect to said transport means.

8. An amusement device according to claim 6, wherein said engaging mechanism comprises a carrier provided with a slot, and cams arranged in opposite relationship, said cams extending into said slot, and wherein said carriage comprises a flange which can be moved into said slot, whereby said cams can be pivoted against said spring force from a clamping position, in which said cams abut against each other or against the flange, to an unlocked position, in which said cams are spaced from each other and from said flange.

9. An amusement device according to claim 8, wherein said engaging mechanism comprises at least two slides which are movable with respect to said carrier, wherein said slides are positioned on a side of the carrier remote from said slot, and said slides are movable against spring force in a direction extending transversely to said slot whilst pivoting the cams from said clamping position to said unlocked position, further comprising arms selectably engaging said slides to move them against spring force.

10. An amusement device according to claim 9, characterized in that said slides are movable in the direction of transport with respect to said arms.

11. An amusement device according to claim 9, characterized in that each slide is provided, on a side facing towards the associated arm, with rollers which are capable of rolling movement on said arm.

12. An amusement device according to claim 6, characterized in that said engaging mechanism comprises a speedometer.

13. An amusement device according to claim 9, characterized in that said arms are disposed near a carriage engaging area and near a carriage releasing area.

14. An amusement device according to claim 6, wherein said guide slopes upward at an angle and has an upper end, further comprising a clamping mechanism near said upper end of said guide, said clamping mechanism connectable to said carriage.

15. An amusement device according to claim 6, wherein said engaging mechanism is movable by means of an endless chain.

16. An amusement device according to claim 6, wherein said engaging mechanism is movable by means of a linear motor.

17. An amusement device according to claim 6, comprising a plurality of carriages, each said carriage comprising a flange, and a plurality of engaging mechanisms, wherein each of said engaging mechanisms is connectable to one of said flanges.

* * * * *